US010273033B2

(12) United States Patent
Heisner et al.

(10) Patent No.: US 10,273,033 B2
(45) Date of Patent: Apr. 30, 2019

(54) ASYMMETRIC PRESSURIZED PLASTIC CONTAINER

(75) Inventors: David B. Heisner, York, PA (US); Sheldon E. Yourist, York, PA (US); J. Andrew Osgood, Milford, NH (US); David P. Piccioli, Auburn, NH (US)

(73) Assignee: GRAHAM PACKAGING COMPANY, L.P., York, PA (US)

( * ) Notice: Subject to any disclaimer, the term of this patent is extended or adjusted under 35 U.S.C. 154(b) by 1626 days.

(21) Appl. No.: 13/423,151

(22) Filed: Mar. 16, 2012

(65) Prior Publication Data

US 2013/0240540 A1 Sep. 19, 2013

(51) Int. Cl.

| | |
|---|---|
| ***B65D 1/42*** | (2006.01) |
| ***B65D 1/44*** | (2006.01) |
| ***B65D 1/02*** | (2006.01) |
| ***B65D 23/10*** | (2006.01) |
| ***B65D 79/00*** | (2006.01) |

(52) U.S. Cl.

CPC ..... *B65D 1/0223* (2013.01); *B65D 23/102* (2013.01); *B65D 79/005* (2013.01); *B65D 2501/0036* (2013.01)

(58) Field of Classification Search

CPC ..... B65D 23/102; B65D 2501/0036
See application file for complete search history.

(56) References Cited

U.S. PATENT DOCUMENTS

| | | | | |
|---|---|---|---|---|
| 5,927,533 | A * | 7/1999 | Payne et al. | 215/384 |
| 7,364,046 | B2 | 4/2008 | Joshi et al. | |
| 7,469,796 | B2 | 12/2008 | Kamineni et al. | |
| 8,091,720 | B2 | 1/2012 | Colloud | |
| 2004/0144748 | A1 | 7/2004 | Slat et al. | |
| 2007/0102316 | A1 | 5/2007 | Van Der Krogt et al. | |
| 2007/0257003 | A1 | 11/2007 | Colloud | |

FOREIGN PATENT DOCUMENTS

| | | |
|---|---|---|
| JP | H 07 137725 | 5/1995 |

* cited by examiner

*Primary Examiner* — Andrew T Kirsch
(74) *Attorney, Agent, or Firm* — Baker Botts L.L.P.

(57) ABSTRACT

An asymmetric pressurized plastic container includes a bottom, a shoulder portion and a finish portion that is unitary with an upper end of the shoulder portion. A generally cylindrical bumper portion having a first longitudinal axis is provided at a lower end of the shoulder portion. A generally cylindrical main body portion having a second longitudinal axis is positioned beneath the bumper portion and has at least a first sidewall feature defined therein. The first and second longitudinal axes are offset so as to compensate for any lateral deflection of the container that may occur as a result of pressurization acting upon the first sidewall feature. In addition, the main body portion may include a second sidewall feature to provide additional compensation against lateral deflection of the container causes a result of pressurization acting upon the first sidewall feature.

11 Claims, 10 Drawing Sheets

ASYMMETRIC PRESSURIZED PLASTIC CONTAINER

BACKGROUND OF THE INVENTION

1. Field of the Invention

This invention relates generally to the field of pressurized plastic containers, and more specifically to a pressurized plastic container that is designed to compensate against any tilting or lateral deflection that might otherwise occur under pressurization as a result of the asymmetry of features such as finger grips that are molded into the sidewall of the container.

2. Description of the Related Technology

A pressurized plastic container is defined as a container that is designed to withstand significant internal pressurization during use. Plastic carbonated beverage containers and plastic aerosol containers both fall within this definition. Carbonated beverages or malt beverages can generate significant internal pressure, on the order of 45-60 psi for malt beverages such as beer. Aerosol containers commonly require internal pressures of the magnitude of 50-300 psi.

Conventional pressurized plastic containers have been designed to have sidewall features that are substantially symmetrical about a longitudinal axis. When a plastic container is pressurized, significant radial and longitudinal forces are applied to the container sidewall. The radial force component has a tendency to cause the sidewall to bow outwardly. Circumferential reinforcement or "hoop strength" must be designed into the container in order to compensate against this.

The longitudinal force component caused by pressurization tends to create a "bellows effect" with respect to features that are molded into the sidewall, which results in elongation of the container. If the sidewall features are not symmetrical about the longitudinal axis of the container, the longitudinal elongation is uneven, resulting in undesirable "tilting" or lateral deflection of the container when it is in the pressurized state. The tilting can be of a magnitude that is noticeable by even a casual observer. In addition, it can cause problems with the automated conveyance and filling of the container at the bottling plant.

Both circumferential and longitudinal deflection can be reduced by increasing the sidewall thickness of the container. However, this increases the material costs to the product manufacturer and ultimately the consumer. The packaging industry is extremely price competitive, and a container design that permits lightweighting of a container without a sacrifice in container performance may have considerable commercial value.

The consumer beverage market is also extremely competitive, and manufacturers of carbonated beverages such as soft drinks and beer look favorably upon packaging that aesthetically distinguishes their products in a manner that complements their product marketing and advertising. In addition, features such as finger grip recesses provide utilitarian advantages to consumers that are in demand. Unfortunately, the introduction of stylized container designs into the carbonated beverage market has been frustrated by the deflection issues caused by pressurization and the lightweighting concerns described above.

A need exists for an asymmetric pressurized plastic container that resists or provides compensation against tilting under pressurization conditions without significantly increasing the material costs of the container.

SUMMARY OF THE INVENTION

Accordingly, it is an object of the invention to provide an asymmetric pressurized plastic container that resists or provides compensation against tilting under pressurization conditions without significantly increasing the material costs of the container.

In order to achieve the above and other objects of the invention, an asymmetric pressurized plastic container according to a first aspect of the invention includes a bottom, a shoulder portion, a finish portion that is unitary with an upper end of the shoulder portion and a generally cylindrical main body portion. The main body portion has a sidewall that is shaped to be asymmetrical with respect to a longitudinal axis thereof. The sidewall has a first feature defined therein on a first side of the main body portion and a second feature defined therein on a second side of the main body portion. The second feature provides at least partial compensation against lateral deflection of the container along the longitudinal axis that is caused by the first feature.

An asymmetric pressurized plastic container according to a second aspect of the invention includes a bottom, a shoulder portion, a finish portion that is unitary with an upper end of the shoulder portion, a generally cylindrical bumper portion positioned at a lower end of the shoulder portion and defining a first longitudinal axis and a generally cylindrical main body portion positioned between the bumper portion and the bottom. The main body portion has a generally cylindrical sidewall that defines a second longitudinal axis that is offset from the first longitudinal axis. The sidewall has a first feature defined therein, and any lateral deflection of the main body portion caused by the first feature as a result of pressurization of the container is at least partially compensated by the offset between the first and second longitudinal axes.

These and various other advantages and features of novelty that characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT(S)

Figure 1:
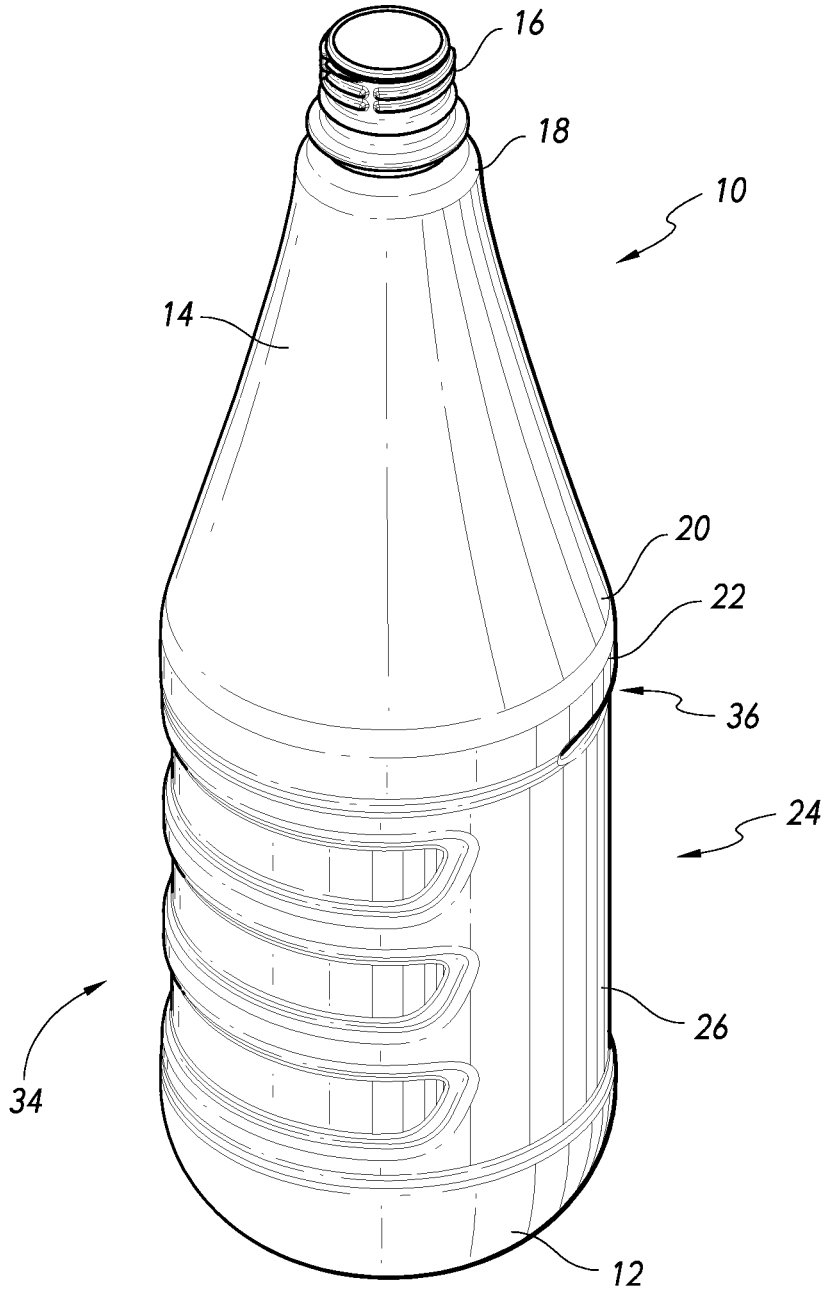
FIG. 1 is a perspective view of a pressurized plastic container that is constructed according to a preferred embodiment of the invention.

Referring now to the drawings, wherein like reference numerals designate corresponding structure throughout the views, and referring in particular to FIG. 1, an asymmetric pressurized plastic container 10 that is constructed according to a preferred embodiment of the invention includes a bottom portion 12, a shoulder portion 14 and a finish portion 16 that is unitary with an upper end 18 of the shoulder portion 14. The finish portion 16 is preferably threaded so as to be constructed and arranged to receive a closure, such as a plastic screw cap.

Preferably, the entire container 10 is formed from a plastic material such as polyethylene terephthalate (PET) using the standard stretch reheat blow molding process. Alternatively, the container 10 could be fabricated from another plastic material, such as polyethylene naphthalate (PEN), acrilonitrile (AN), polycarbonate (PC), polyamide (Nylon), or a blend containing some combination of the same. Container 10 could alternatively be fabricated using an extrusion blow molding process or an injection blow molding process.

Container 10 is further preferably constructed and arranged to withstand significant internal pressurization of the magnitude that is typical for carbonated beverages, namely 45-60 psi.

Alternatively, the container 10 may be a plastic aerosol container that includes an aerosol propellant. In this embodiment, the container 10 would preferably be constructed and arranged to withstand aerosol pressurization within a range of about 50 psig to about 300 psig. More preferably, it would be constructed and arranged to withstand aerosol pressurization within a range of about 120 psig to about 180 psig. The container assembly 10 is preferably pressurized with an aerosol mixture at a range of pressurization that is substantially between about 50 psig to about 300 psig, and more preferably substantially within a range of about 120 psig to about 180 psig. The aerosol mixture would preferably include a propellant, which could be a liquefied gas propellant or a compressed or soluble gas propellant. Liquefied gas propellants that could be used include hydrocarbon propellants such as propane, isobutene, normal butane, isopentane, normal pentane and dimethyl ether, and hydrofluorocarbon propellants such as difluoroethane (HFC-152a) and tetrafluoroethane (HFC-134a). Compressed and soluble gas propellants that could be used include carbon dioxide (CO2), nitrous oxide (N2O), nitrogen (N2) and compressed air.

The asymmetric pressurized plastic container 10 further preferably includes a substantially cylindrical upper bumper portion 22 that is unitary with a lower end 20 of the shoulder portion 14. A second, lower substantially cylindrical bumper portion 30 is unitary with an upper end of the bottom portion 12. The respective bumper portions 22, 30 preferably have substantially the same diameter and are in substantial alignment with each other. Container 10 would accordingly be what is termed in the industry a round container, meaning that the extreme lateral periphery of the container has a substantially cylindrical shape.

The container 10 further includes a main body portion 24 that is positioned between and unitary with the upper bumper portion 22 and the lower bumper portion 30. The main body portion 24 preferably has a sidewall 26 that is substantially cylindrical, but may have non-symmetrical or asymmetrical indentation patterns defined in the sidewall 26 for aesthetic or structural reinforcement purposes as will be described in greater detail below.

Figure 2:
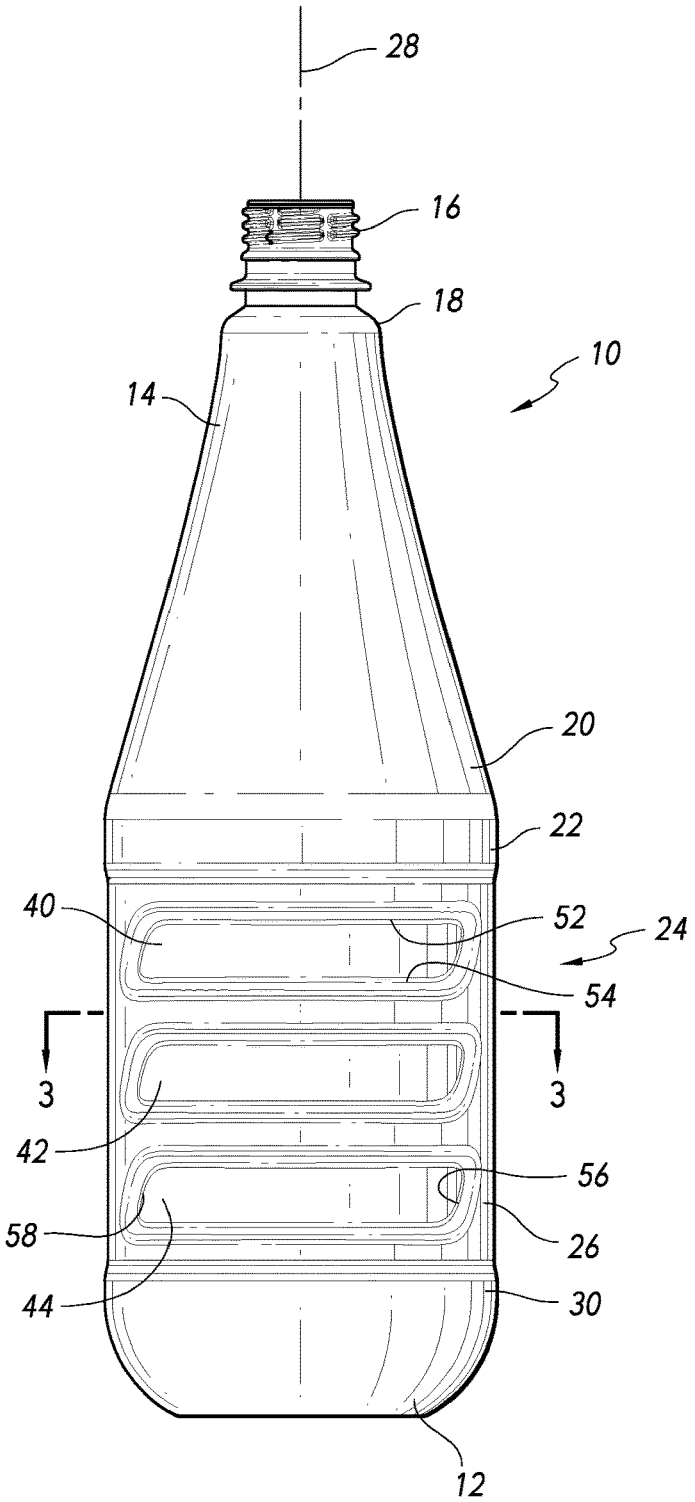
FIG. 2 is a front elevational view of the pressurized plastic container that is depicted in FIG. 1.
Figure 3:
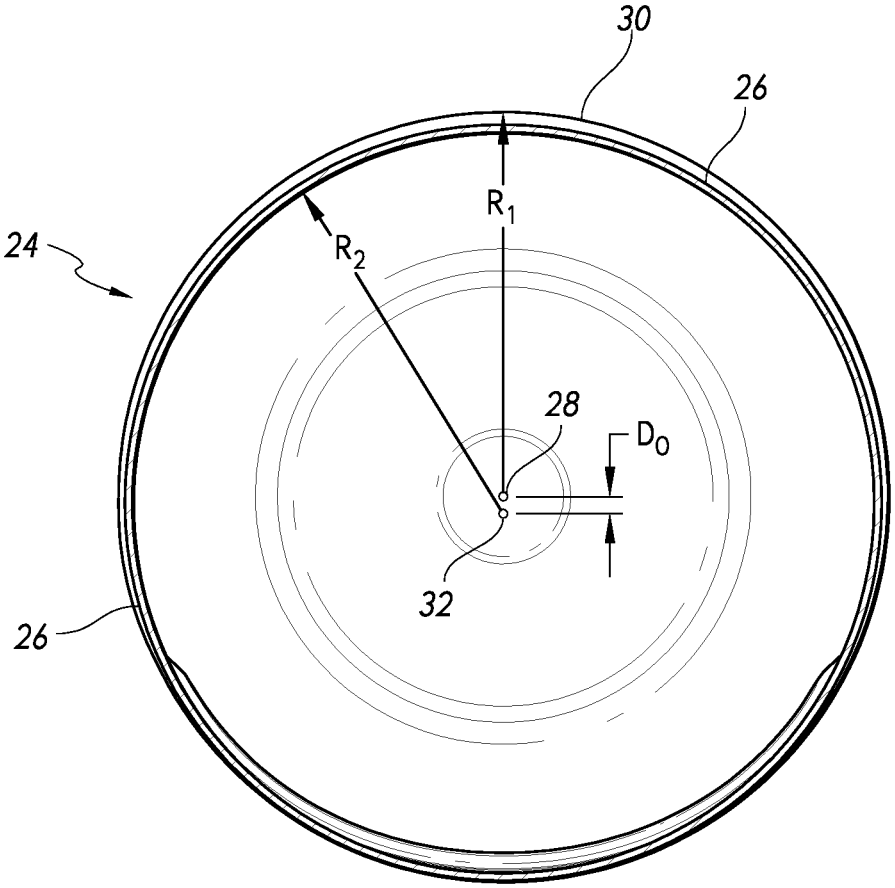
FIG. 3 is a transverse cross-sectional view taken along lines 3-3 in FIG. 2.
Figure 4:
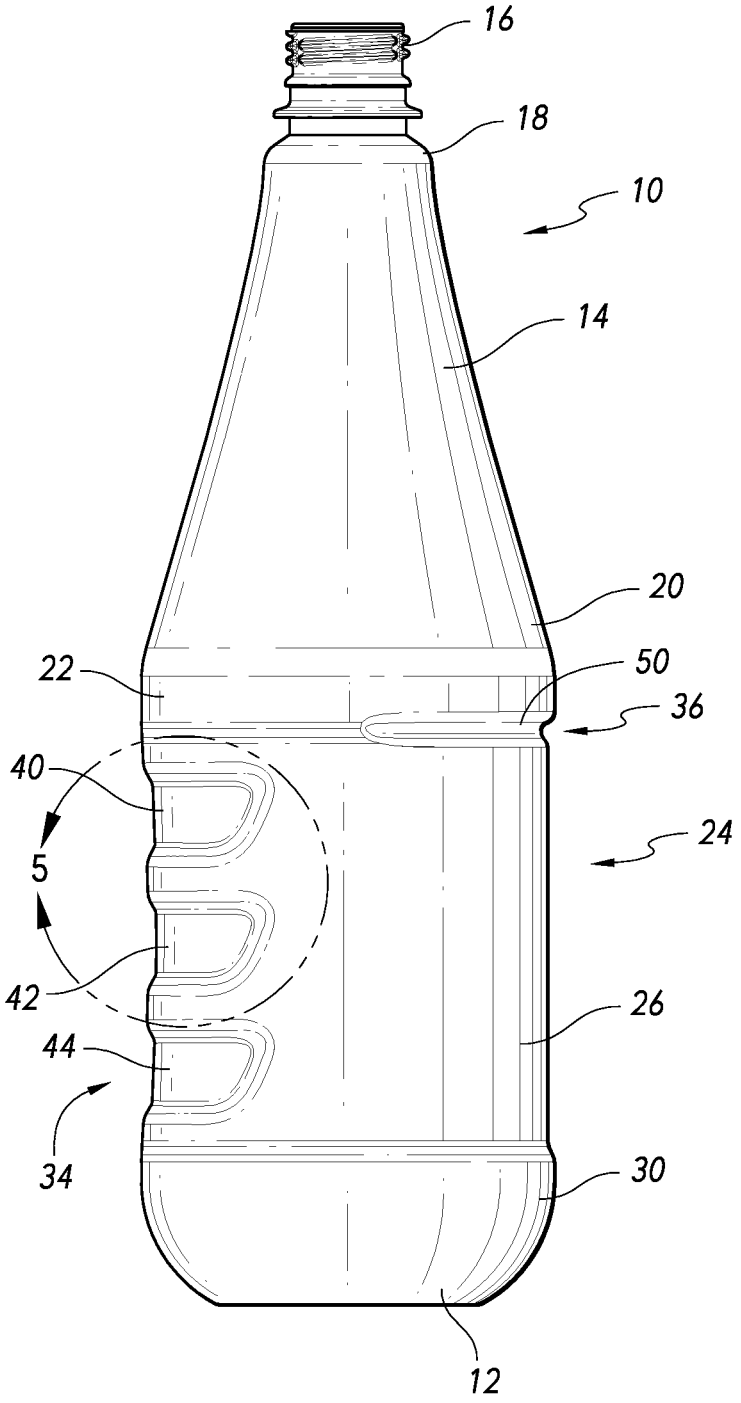
FIG. 4 is a side elevational view of the pressurized plastic container that is depicted in FIG. 1.
Figure 8:
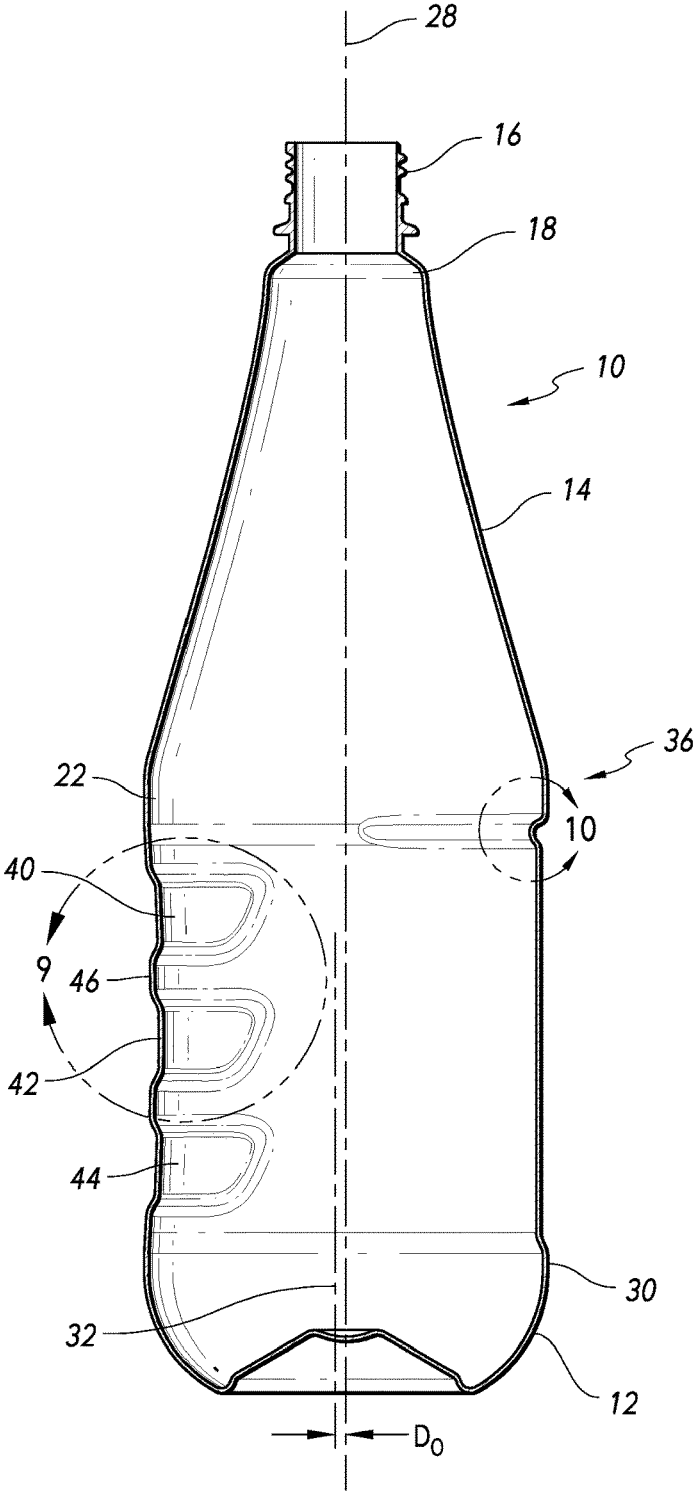
FIG. 8 is a longitudinal cross-sectional view of the pressurized plastic container that is depicted in FIG. 1.
Figure 9:
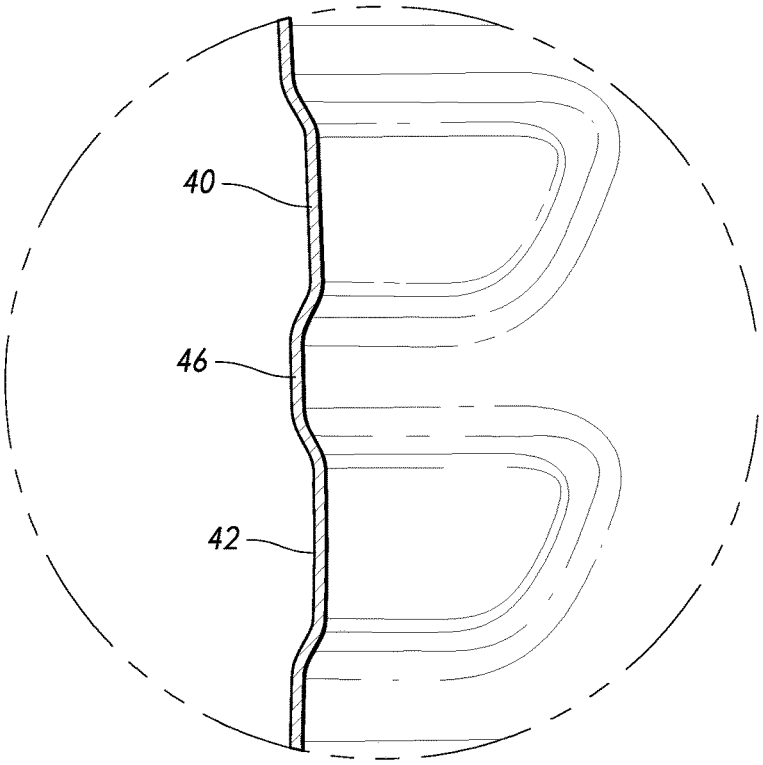
FIG. 9 is a close up view of the portion of the pressurized plastic container that is indicated by the broken line circle 9-9 in FIG. 8.

As is best shown in FIGS. 2, 3 and 8, the plastic container 10 has a longitudinal axis 28. The substantially cylindrical upper and lower bumper portions 22, 30 are preferably substantially symmetrical about the longitudinal axis 28, having a radius $R_1$, as shown in FIG. 3. The main body portion 24 is preferably asymmetrical or non-symmetrical with respect to the remainder of the container 10, such as the upper and lower bumper portions 22, 30. The main body portion 24 is further preferably shaped so as to be substantially cylindrical, with a radius $R_2$, about a second longitudinal axis 32 that is laterally offset from the first longitudinal axis 28 by a distance $D_O$, as is best shown in FIGS. 3 and 8.

Preferably, the lateral offset of the main body portion is in a direction that is towards the side of the main body portion 24 that has the most prominent surface features, in other words the side that would tend to elongate the most under pressurization conditions. It has been found that such an orientation of offset is effective at reducing the amount of tilting or lateral deflection of the container 10 under pressurization conditions.

The sidewall 26 of the substantially cylindrical main body portion 24 is also preferably shaped to define surface features that are asymmetrical with respect to its own longitudinal axis 32. In the illustrated embodiment, sidewall 26 has a first feature 34 defined therein on a first side of the main body portion 24 and a second feature 36 defined therein on a second side of the main body portion 24. The second feature 36 is preferably constructed and arranged so as to provide at least partial compensation against lateral deflection of the container 10 with respect to the longitudinal axis 28 as a result of internal pressurization of the container 10.

In the illustrated embodiment, the first feature 34 includes a plurality of finger recess grooves 40, 42, 44 that are defined in the sidewall 26 of the main body portion 24. The main body portion 24 further includes a substantially cylindrical outer surface 46 that creates a raised portion in between the respective finger recess grooves 40, 42, 44.

Figure 5:
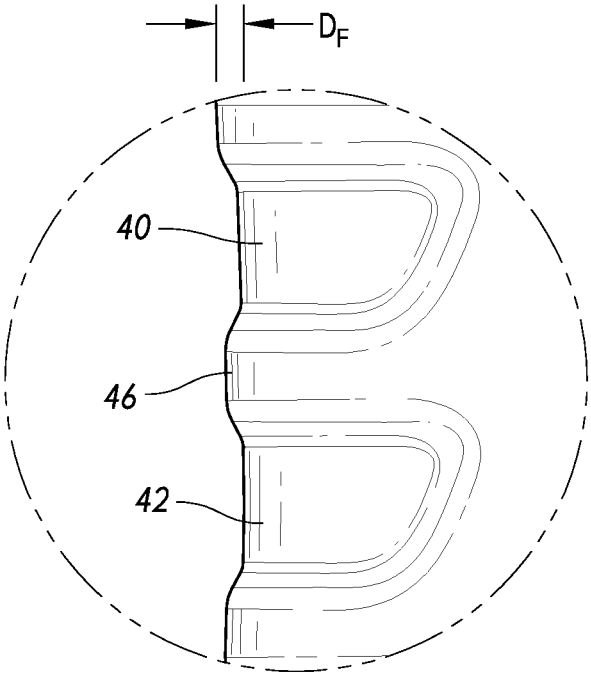
FIG. 5 is a close up view of the portion of the pressurized plastic container that is indicated by the broken line circle 5-5 in FIG. 4.
Figure 6:
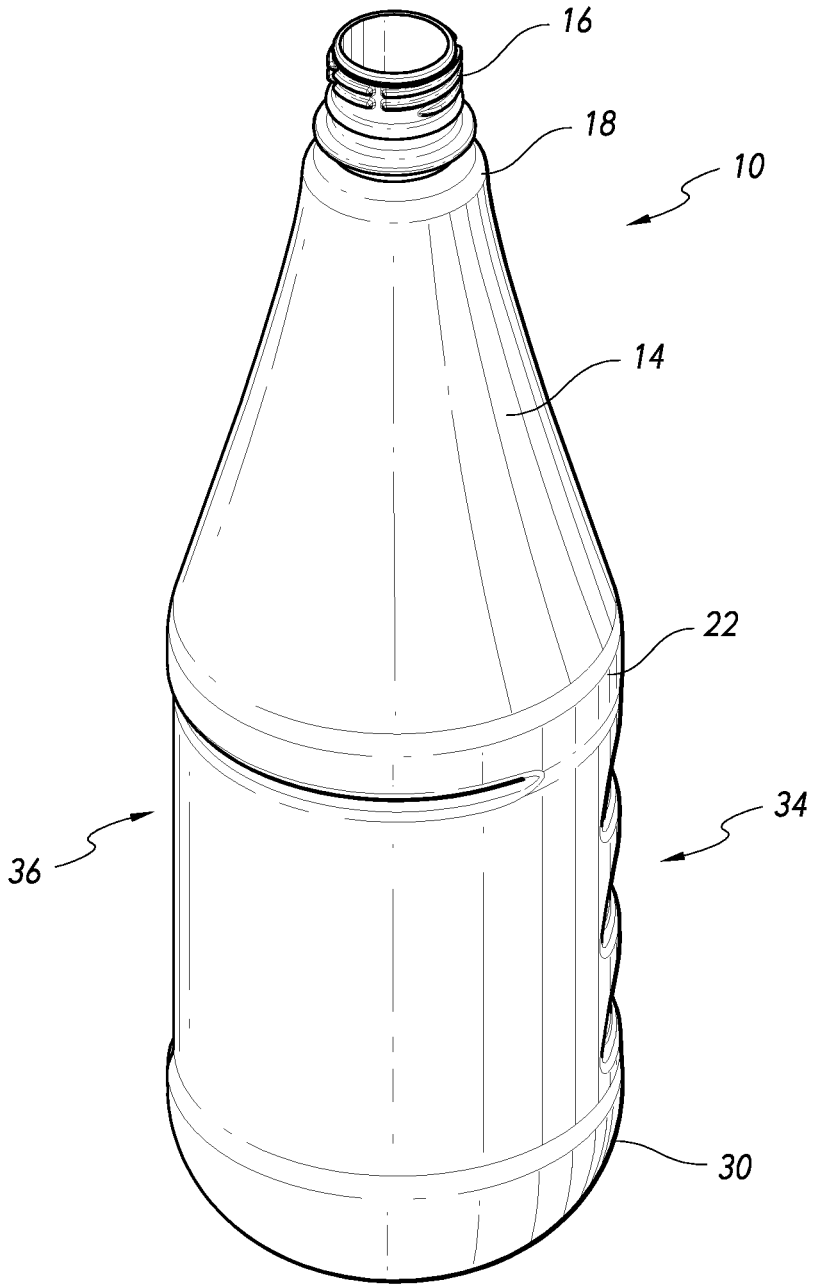
FIG. 6 is a second perspective view of the pressurized plastic container that is shown in FIG. 1.
Figure 7:
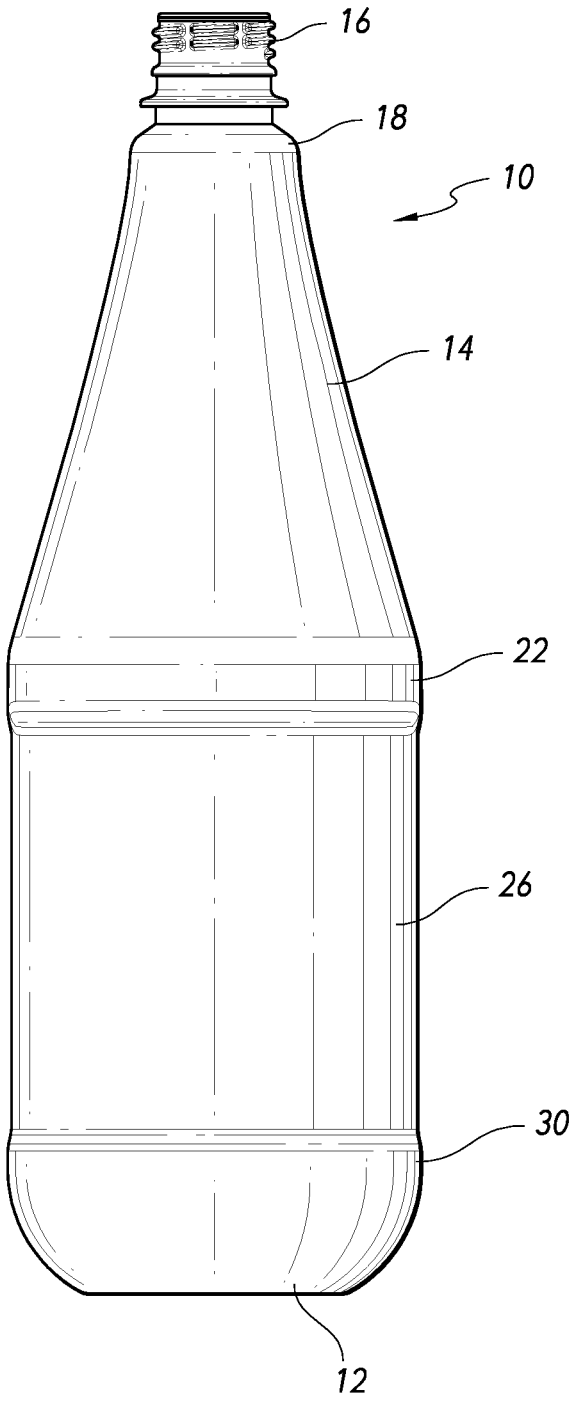
FIG. 7 is a rear elevational view of the pressurized plastic container that is shown in FIG. 1.

Each of the finger recess grooves 40, 42, 44 preferably has a parallelogram shape, as may best be seen in FIG. 2, including substantially horizontal upper and lower surfaces 52, 54 and angled side surfaces 56, 58 that are substantially parallel to each other. The parallelogram shape has been found to reduce the amount of elongation or bellowing that is caused by the presence of the finger recess grooves 40, 42, 44 under conditions of pressurization. The reduction in elongation may be associated with the minimization of the circumferential extent of the portion of the finger recess groove in which there is an uninterrupted concave groove surface between the horizontal upper and lower surfaces 52, 54. The finger recess grooves 40, 42, 44 also preferably have a maximum depth $D_F$, as is best shown in FIG. 5.

Figure 10:
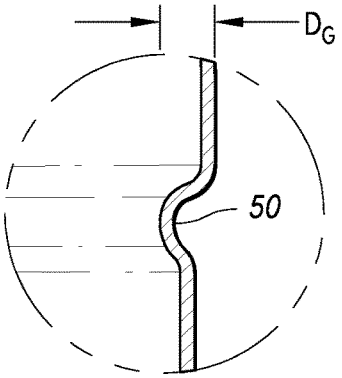
FIG. 10 is a close up view of the portion of the pressurized plastic container that is indicated by the broken line circle 10-10 in FIG. 8.

In the preferred embodiment, the second feature 36 comprises at least one compensation groove 50 that is defined in a side of the main body portion 24 that is substantially diametrically opposed to the finger recess grooves 40, 42, 44. The compensation groove 50 has a maximum depth $D_G$, as is best shown in FIG. 10. Preferably, the maximum depth $D_G$ of the compensation groove 50 is greater than the maximum depth $D_F$ of the finger recess grooves 40, 42, 44.

In the preferred embodiment, the compensation groove 50 is oriented so as to be substantially within a plane that is transverse to the longitudinal axis 32. The compensation groove 50 also preferably extends for only a portion of the circumference of the main body portion 24. Most preferably, the compensation groove extends for a portion of the circumference of the main body portion 24 that subtends an angle that is less 180°. One reason for this is that any portion of the compensation groove 50 that would be situated on a common side of the main body portion 24 with the first feature 34 would tend to exacerbate elongation of the sidewall on the common side, rather than compensate for it.

While the preferred embodiment of the invention includes a compensation feature that is diametrically opposed from a feature that will tend to expand under pressurization conditions, it should be understood that in alternative embodiments compensation features could be provided selectively about the periphery of the container in order to compensate for longitudinal expansion of the container under pressure as a result of multiple features that are not all positioned on a single side of the container.

Several factors are important in determining the shape, size and location of the second feature 36 in order to minimize lateral deflection or tilting of the container under pressurization conditions as a result of the presence of the first feature 34. One factor is the respective lengths as measured along the surface of the sidewall 26 on the first and second sides of the main body portion 24 within a longitudinal plane, such as is shown in FIG. 8. As the bellowing effect in the extreme scenario would result in the complete straightening of the sidewall features under pressurization conditions, designing a container to have similar sidewall lengths about the entire periphery would tend to provide compensation against lateral deflection or tilting. However, other factors also contribute to the amount of relative sidewall elongation when the container is pressurized. These include the shape of the respective sidewall features and differences in sidewall thickness.

Figure 11:
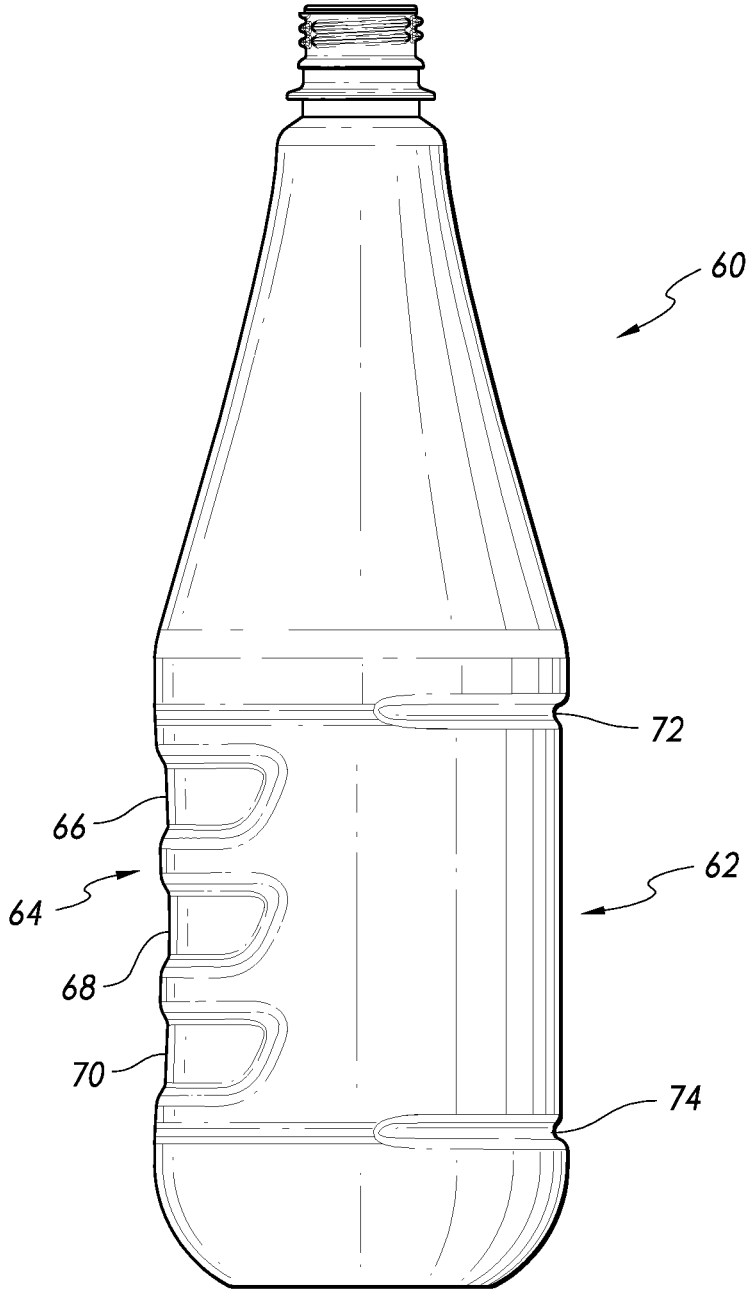
FIG. 11 is a side elevational view of a pressurized plastic container that is constructed according to a second embodiment of the invention.

FIG. 11 depicts a asymmetrical pressurized plastic container 60 that is constructed according to a second embodiment of the invention. Container 60 includes a main body portion 62 having a first sidewall feature 64, which includes a plurality of grip recesses 66, 68, 70. The main body portion 62 further includes a second sidewall feature on an opposing side of the container that includes a first compensating groove 72 located in an upper portion of the main body portion 62 and a second compensating groove 74 that is defined in a lower portion of the main body portion 62. In alternative embodiments, three, four or more compensating grooves could be used.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. An asymmetric pressurized plastic container, comprising:

a bottom;

a shoulder portion;

a finish portion that is unitary with an upper end of the shoulder portion;

a generally cylindrical bumper portion positioned at a lower end of the shoulder portion and defining a first longitudinal axis; and a generally cylindrical main body portion positioned between the bumper portion and the bottom, the main body portion having a generally cylindrical sidewall that defines a second longitudinal axis that is offset from the first longitudinal axis, the sidewall having a first feature defined therein on a first side of the main body portion and a compensation groove defined on a second side of the main body portion separate from the first feature, the compensation groove extending along only a portion of a circumference of the main body portion, and wherein any lateral deflection of the main body portion caused by the first feature as a result of pressurization of the container is at least partially compensated by the offset between the first and second longitudinal axes.

2. An asymmetric pressurized plastic container according to claim 1, wherein the first feature comprises a finger recess groove.

3. An asymmetric pressurized plastic container according to claim 2, wherein the first feature comprises a plurality of finger recess grooves.

4. An asymmetric pressurized plastic container according to claim 1, wherein the compensation groove is positioned so as to be substantially diametrically opposed from the first feature.

5. An asymmetric pressurized plastic container according to claim 1, wherein the compensation groove is oriented substantially within a plane that is substantially transverse to the second longitudinal axis of the main body portion.

6. An asymmetric pressurized plastic container according to claim 1, wherein the compensation groove extends for a portion of the circumference of the main body portion that subtends an angle that is less than 180°.

7. An asymmetric pressurized plastic container according to claim 1, wherein the first feature comprises a plurality of finger recesses having a first maximum depth and wherein the compensation groove has a second maximum depth, and wherein the second maximum depth is greater than the first maximum depth.

8. An asymmetric pressurized plastic container according to claim 1, wherein the first feature comprises at least one finger grip recess, and wherein the at least one finger grip recess has a parallelogram shape.

9. An asymmetric pressurized plastic container, comprising:

a bottom;

a shoulder portion;

a finish portion that is unitary with an upper end of the shoulder portion; and a generally cylindrical main body portion having a sidewall that is shaped to be asymmetrical with respect to a central longitudinal axis thereof, the sidewall having a first feature defined therein on a first side of the main body portion and a second feature defined therein on a second side of the main body portion separate from the first feature, wherein the second feature extends along only a portion of a circumference of the main body portion that subtends an angle that is less than 180° and is configured to provide at least partial compensation against lateral deflection of the container along the central longitudinal axis caused by the first feature.

10. An asymmetric pressurized plastic container, comprising:

a bottom;

a shoulder portion;

a finish portion that is unitary with an upper end of the shoulder portion; and a generally cylindrical main body portion having a sidewall that is shaped to be asymmetrical with respect to a central longitudinal axis thereof, the sidewall having a first feature defined therein on a first side of the main body portion and a second feature defined therein on a second side of the main body portion separate from the first feature, wherein the second feature extends along only a portion of a circumference of the main body portion and configured to provide at least partial compensation against lateral deflection of the container along the central longitudinal axis caused by the first feature, wherein the second feature comprises a compensation groove, wherein the first feature comprises a plurality of finger recesses having a first maximum depth, wherein the compensation groove has a second maximum depth, and wherein the second maximum depth is greater than the first maximum depth.

11. An asymmetric pressurized plastic container comprising a bottom;

a shoulder portion;

a finish portion that is unitary with an upper end of the shoulder portion; and a generally cylindrical main body portion having a sidewall that is shaped to be asymmetrical with respect to a central longitudinal axis thereof, the sidewall having a first feature defined therein on a first side of the main body portion and a second feature defined therein on a second side of the main body portion separate from the first feature, wherein the second feature extends along only a portion of a circumference of the main body portion and configured to provide at least partial compensation against lateral deflection of the container along the central longitudinal axis caused by the first feature; and a substantially cylindrical bumper portion that is positioned between the main body portion and the shoulder portion, and wherein the bumper portion has a central longitudinal axis that is offset from the central longitudinal axis of the main body portion.

* * * * *